US005292058A

United States Patent [19]

Zoss et al.

[11] Patent Number: 5,292,058

[45] Date of Patent: Mar. 8, 1994

[54] PACKAGE INCLUDING AN EXPANDABLE TOP OPENING

[75] Inventors: Robert A. Zoss, Minneapolis; Francis M. Snee, Brooklyn Park, both of Minn.

[73] Assignee: General Mills, Inc., Minneapolis, Minn.

[21] Appl. No.: 51,961

[22] Filed: Apr. 26, 1993

[51] Int. Cl.[5] ..... B65D 5/08

[52] U.S. Cl. ..... 229/123; 206/268; 206/273

[58] Field of Search ..... 229/123; 206/274, 273, 206/268; 383/120

[56] References Cited

U.S. PATENT DOCUMENTS

| | | | |
|---|---|---|---|
| 641,500 | 1/1900 | Davidson . | |
| 1,995,516 | 3/1935 | Miller . | |
| 2,176,912 | 10/1939 | Luckett | 206/273 X |
| 2,395,663 | 2/1946 | Howard . | |
| 2,540,342 | 2/1951 | Moore . | |
| 2,634,900 | 4/1953 | Levkoff . | |
| 2,773,636 | 12/1956 | Williams et al. . | |
| 2,791,367 | 5/1957 | Mefford . | |
| 2,853,225 | 9/1958 | Bauer . | |
| 2,865,498 | 12/1958 | Ringler | 206/268 |
| 2,995,288 | 8/1961 | Jesinghaus . | |
| 3,004,696 | 10/1961 | McCormick . | |
| 3,032,249 | 5/1962 | Kollar et al. . | |
| 3,269,644 | 8/1966 | Bump . | |
| 4,742,955 | 5/1988 | Focke et al. | 229/123 |
| 4,955,528 | 9/1990 | Schluckebier . | |
| 5,014,907 | 5/1991 | Hollander et al. . | |

*Primary Examiner*—Allan M. Shoap
*Assistant Examiner*—Christopher McDonald
*Attorney, Agent, or Firm*—L. McRoy Lillehaugen; John A. O'Toole; Alan D. Kamrath

[57] ABSTRACT

A package (10) of a hollow rectangular parallelepiped shape is disclosed including a liner (14) inside of a carton (12). A first score line (72) extends from the free edges (47, 96) of the front and back top closure panels (48, 60) and onto the front and back panels (18, 28) parallel and intermediate the side edges (20, 22, 26, 30, 50, 52, 59, 64) thereof. Second and third score lines (74, 76) are further located in each of the front and back panels (18, 28) and extend at an obtuse angle from and on opposite sides of the first score lines (72), with the score lines (72, 74, 76) having a Y-shape. The bottom of the carton (12) holds the bottom edges (40, 44) of the front, back, and side panels (18, 24, 28, 32) in a rectangular configuration. With the top closure panels (48, 60) in an open condition, the top closure panels (48, 60) and the front and back panels (18, 28) can be flexed into a non-planar shape with the upper edges (48, 56, 62, 68) of the carton panels (18, 24, 28, 32) being open and generally of an oval shape allowing removal of ingredients from the liner (14) by a measuring cup which could not have been inserted into the top opening in a non-expanded, static condition.

19 Claims, 2 Drawing Sheets

PACKAGE INCLUDING AN EXPANDABLE TOP OPENING

BACKGROUND

The present invention generally relates to packages, particularly to packages formed from a blank of a single layer of material, and specifically to packages including an expandable top opening.

Many dry ingredients for baking or the like such as but not limited to pancake mix, biscuit mix, flour, and the like are sold in packaging including a liner which holds the ingredients surrounded by a carton. The typical shape of packages for such dry ingredients is a rectangular parallelepiped to provide narrow widths allowing the package to be held in one hand and to provide large face panels for product identification and promotion. Additionally, such packaging typically holds more than one serving of dry ingredients. Thus, the baker would desire to extract the desired amount of dry ingredients from the package while leaving the balance of the dry ingredients in the package. The width of the top opening of the conventional package is insufficient to allow insertion of a measuring cup through the top opening to the interior of the package. Thus, one method of removing the dry ingredients from the interior of the package was to insert a spoon through the top opening and dig the ingredients out for placement in the measuring cup. However, if a large amount of dry ingredients is desired, such an approach was very time consuming. Alternately, the dry ingredients were attempted to be poured from the package into a measuring cup or the like by tipping the package. However, dry ingredients do not flow evenly like fluids but rather have an avalanche-type flow such that spillage is often a problem. To avoid these problems, often the package was emptied into a canister or the like, with the package then being discarded and the dry ingredients removed from the canister. However, it can be appreciated that once the package is discarded, there may no longer be identification of the particular dry ingredients in the canister, and the baking instructions from the carton are no longer available. Likewise, the consumer may not wish to have canisters for each type of dry ingredient product desired due to the cost of such canisters and the difficulty in storing such canisters. Additionally, the sealing and other attributes of the liner and the package are not obtained after the dry ingredients are emptied into the canister.

Thus, a need exists for a package which allows removal of the dry ingredients from the interior of conventionally shaped packages in a similar manner as allowed by canisters while still maintaining the advantages of prior packages and specifically does not require the dry ingredients to be poured or emptied from the package for use. In a preferred aspect, there is a need for a package which has a top opening which is expandable when it is desired to remove the dry ingredients from the interior of the package by a measuring cup which could not have been inserted into the top opening in its normal, static condition.

SUMMARY

Surprisingly, the above needs and other problems in the field of packages for dry ingredients can be satisfied by providing, in the preferred form, front and back panels which can be flexed into a non-planar shape with the top edges of the front, side, and back panels having a generally oval shape having a length less than the width between the side edges of the front and back panels and a width greater than the width between the side edges of the side panels while the bottom edges of the front, side and back panels are held in a rectangular configuration.

In the preferred form, the front and back panels each include top panels which can be removably secured together in a closed position to form the top of the carton, with the front and back top panels also being flexible into a non-planar shape when in an open position.

In one aspect of the present invention, first score lines are provided extending from the top edges towards the bottom edges of the front and back panels. In the preferred form, second and third score lines intersect with the first score lines in a generally Y-shape on the front and back panels.

These and further aspects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
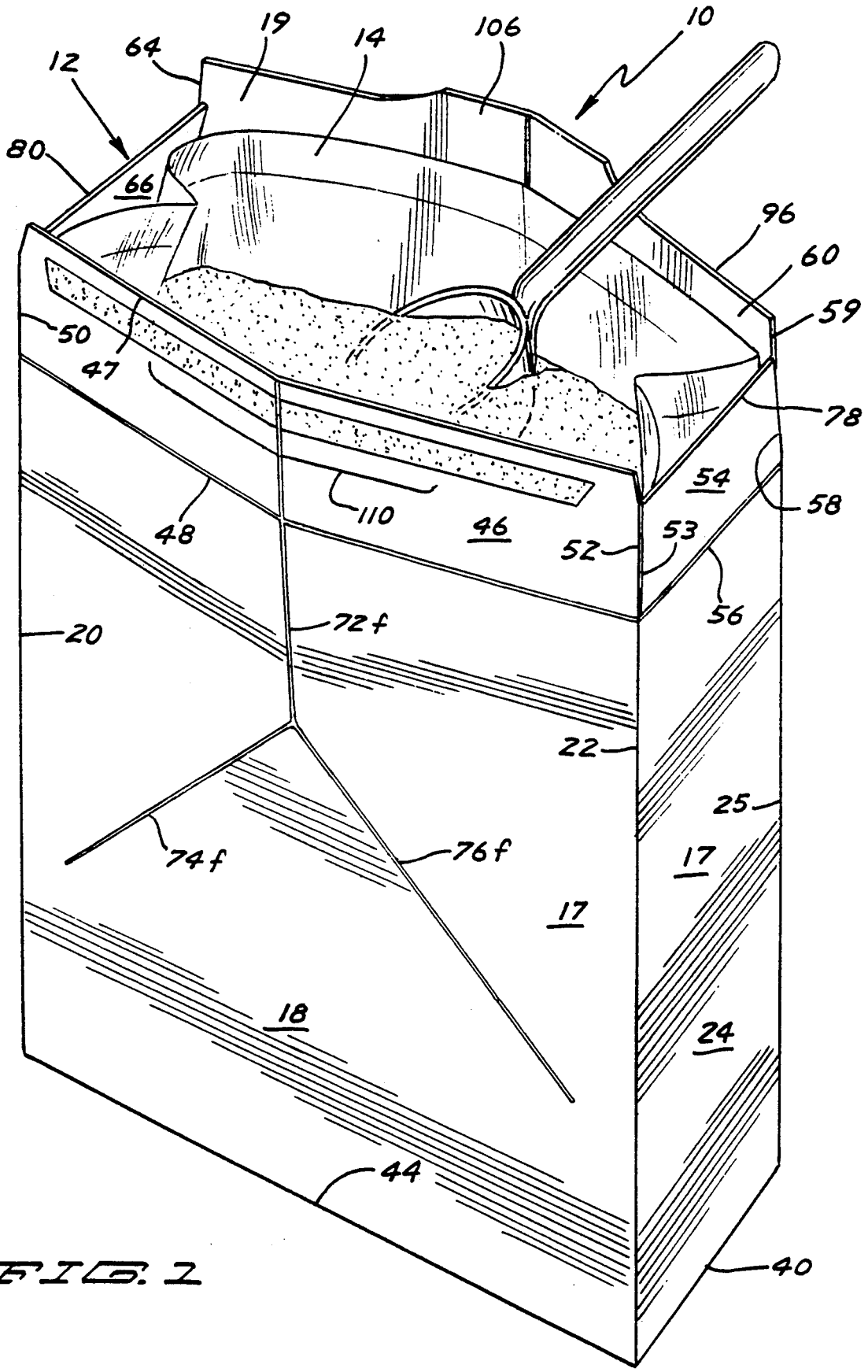
FIG. 1 shows a perspective view of a package including an expandable top opening according to the preferred teachings of the present invention.
Figure 2:
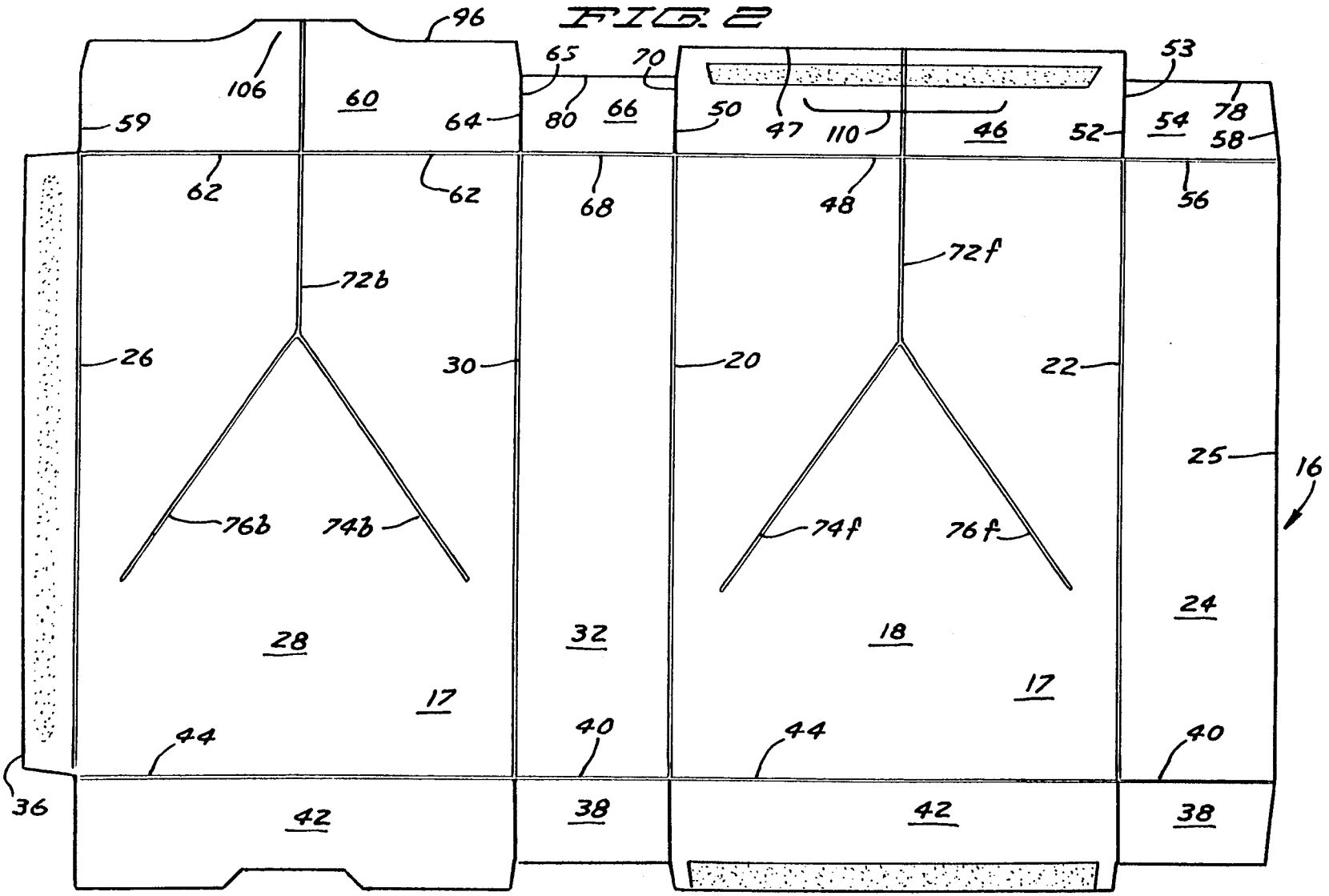
FIG. 2 shows a top plan view of a blank that may be folded into the carton of the package of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "edge", "side", "front", "back", "length", "width", "inner", "outer", and similar terms are used herein, it should be understood that these terms have reference only to the structure shown in the drawings as it would appear to a person viewing the drawings and are utilized only to facilitate describing the invention.

DESCRIPTION

A package according to the preferred teachings of the present invention is shown in the drawings and generally designated 10. Generally, package 10 includes an outer carton 12 and an inner liner 14. Liner 14 can be formed of any suitable material, such as glassine, wax paper, or plastic, and can be formed in any suitable manner as is well known in the art.

Carton 12 according to the teachings of the present invention is formed from a blank 16 of a single layer of generally stiff material such as paperboard. Blank 16 includes an outer surface 17 which has printed material and an inner surface 19 which is plain and does not include printed material. Blank 16 generally includes a rectangular, front panel 18 having a side edge 20 and a second, parallel side edge 22 which is integrally connected to the side edge 22 of a first, rectangular side panel 24 about a fold line. The opposite, parallel side edge 25 of side panel 24 is free. Blank 16 further includes a rectangular back panel 28 having a side edge 26 and a second, parallel side edge 30 integrally connected to the side edge 30 of a second, rectangular side panel 32 about a fold line. The opposite, parallel side edge 20 of side panel 32 is integrally connected to the side edge 20 of front panel 18 about a fold line. The side edge 26 of a glue flap 36 is integrally connected to side edge 26 of back panel 28 about a fold line. Glue flap 36 in the most preferred form has the shape of an isosceles trapezoid with the major base extending along edge 26. Outer surface 17 of flap 36 can be secured to inner surface 19 of side panel 24 by any suitable means such as glue with edges 25 and 26 being coextensive. With the glue flap 36 secured, edge 25 of panel 24 is connected to edge 26 of panel 28 about the fold line between panel 28 and glue flap 36. Panels 18, 24, 28, and 32 have equal heights, with panels 18 and 28 having equal widths which are substantially larger and particularly a multiple of the widths of panels 24 and 32 and specifically which are 2.9 times the widths of panels 24 and 32. In the preferred form, side panels 24 and 32 have equal widths and extend generally perpendicularly between panels 18 and 28 in the most preferred form to form a hollow rectangular parallelepiped.

The bottom of carton 12 can be formed by any suitable manner and is flat. In the preferred form, side panels 24 and 32 include rectangular dust flaps 38 integrally extending from their bottom edges 40 about fold lines and having widths which are identical to side panels 24 and 32, with bottom edges 40 extending perpendicularly between edges 22 and 25 of panel 24 and between edges 20 and 30 of panel 32. Front and back panels 18 and 28 each include generally rectangular closure flaps 42 integrally extending from their bottom edges 44 about fold lines and having widths which are identical to panels 18 and 28, with bottom edges 44 extending perpendicularly between edges 20 and 22 of panel 18 and between edges 26 and 30 of panel 28. The lengths of flaps 38 and 42 from bottom edges 40 and 44 to their respective free edges are at least equal to one-half of the widths of side panels 24 and 32 and of flaps 38 but less than the widths of panels 18, 24, 28, and 32, with the lengths of flaps 38 from bottom edges 40 to their free edges being less than the lengths of flaps 42 from bottom edges 44 to their free edges in the most preferred form. The side edges of flaps 38 and 42 are separated from each other. The bottom of carton 12 can then be formed by folding dust flaps 38 inwardly and generally perpendicular to side panels 24 and 32. Then one of the closure flaps 42 can be folded such that inner surface 19 thereof overlies at least portions of outer surfaces 17 of flaps 38. Thereafter, the other closure flap 42 can be folded such that inner surface 19 thereof overlies outer surfaces 17 of flaps 38 and possibly of portions of the first closure flap 42. The outer surfaces 17 of the inner flaps 38 and/or 42 can be secured to the inner surfaces 19 of the outer flap 42 by any suitable means such as glue.

The top of carton 12 according to the teachings of the present invention can be formed by any suitable manner and is flat. In the most preferred form, blank 16 generally includes a rectangular front top panel 46 having a free top edge 47 and a parallel, bottom edge 48 integrally connected to the top edge 48 of front panel 18 about a fold line, with edge 48 extending perpendicularly between edges 20 and 22 of panel 18. Panel 46 includes a first, free side edge 50 and an opposite, parallel, free side edge 52. Blank 16 further includes a first, rectangular, side top panel 54 having a free top edge 78 and a bottom edge 56 integrally connected to the top edge 56 of side panel 24 about a fold line, with edge 56 extending perpendicularly between edges 22 and 25 of panel 24. Panel 54 includes a first, free side edge 53 adjacent and parallel to side edge 52 of panel 46 and an opposite, parallel, side edge 58. Blank 16 further includes a generally rectangular back top panel 60 having a free top edge 96 and a bottom edge 62 integrally connected to the top edge 62 of back panel 28 about a fold line, with edge 62 extending perpendicularly between edges 26 and 30 of panel 28. Panel 60 includes a first, free side edge 59 and an opposite, parallel, free side edge 64. Blank 16 further includes a second, rectangular side top panel 66 having a free top edge 80 and a bottom edge 68 integrally connected to the top edge 68 of side panel 32 about a fold line, with edge 68 extending perpendicularly between edges 20 and 30 of panel 32. Panel 66 includes a first, free side edge 65 adjacent and parallel to edge 64 of panel 60 and an opposite, parallel, side edge 70 adjacent and parallel to edge 50 of panel 46.

The top of carton 12 can then be formed by folding top panels 54 and 66 inwardly and generally perpendicular to side panels 24 and 32. Then panel 46 can be folded such that inner surface 19 thereof overlies at least portions of outer surfaces 17 of panels 54 and 66. Thereafter, panel 60 can be folded such that inner surface 19 thereof overlies outer surfaces 17 of panels 54 and 66 and of portions of panel 46. Panel 60 can be secured to panel 46 by any suitable means. For example, at the factory, the top of carton 12 can be secured by glue located on outer surface 17 of panel 46 abutted by inner surface 19 of panel 60, with the glue securement being releasable by the consumer to open the top of carton 12. To removably secure panel 60 to panel 46, free edge 96 of panel 60 includes a contiguous tab 106 extending therefrom which can be slideably received in a U-shaped die cut 110 formed in panel 46 spaced inwardly of free edge 47 and side edges 50 and 52 of top panel 46 complementary and corresponding to tab 106. To open carton 12 for access to the interior thereof and the dry ingredients located therein, the securement of panel 60 to panel 46 is removed, panels 46, 54, 60, and 66 are then folded to extend generally linearly from panels 18, 24, 28, and 32, respectively. Alternately, panels 46, 54, 60, and 66 can be pivoted about their respective fold lines such that inner surfaces 19 thereof extend at an obtuse angle up to 360° to inner surfaces 19 of panels 18, 24, 28, and 32. It should be noted that the fold lines between edges 20, 22, 26, 30, 40, 44, 48, 56, 62, and 68 are formed by scoring blank 16 and particularly by linearly indenting outer surface 17 creating a concave channel depression therein and creating a convex linear projection in inner surface 19.

Carton 12 as described thus far is of a conventional construction and does not form part of the present invention. It should be appreciated that carton 12 can have a variety of different types of construction other than as shown and described according to the teachings of the present invention.

Carton 12 according to the teachings of the present invention includes provisions for expanding the top opening thereof. In the most preferred form, panels 18 and 46 include a linear score line 72*f* extending parallel and intermediate edges 20 and 22 and edges 50 and 52 from edge 47 to edge 48 and from edge 48 towards edge 44 to a location spaced from edge 44 and particularly about 28% of the height of panel 18. Similarly, panels 28 and 60 include a linear score line 72*b* extending parallel and intermediate edges 26 and 30 and edges 59 and 64 from edge 96 to edge 62 and from edge 62 to a location spaced from edge 44 and particularly about 28% of the height of panel 28. Panel 18 further includes first and second, linear score lines 74*f* and 76*f* extending from and on opposite sides of the end of score line 72*f* at an obtuse angle in the order of 145° and spaced from edge 48. The first ends of score lines 74*f* and 76*f* are interconnected, with score lines 74*f* and 76*f* extending at an acute angle in the order of 70° from each other. The free ends of score lines 74*f* and 76*f* extend towards but are spaced from edges 20 and 22, respectively, with the free ends of score lines 74*f* and 76*f* located approximately 9% of the width between edges 20 and 22 from edges 20 and 22, respectively, in the preferred form. Also, the first ends of score lines 74*f* and 76*f* are located at a greater distance from edge 44 than their free ends, with the free ends of score lines 74*f* and 76*f* extending towards but spaced from edge 44 and specifically with the free ends of score lines 74*f* and 76*f* located approximately 30% of the height between edges 44 and 48 from edge 44 in the preferred form. Thus, score lines 72*f*, 74*f*, and 76*f* have a Y-shape spaced from edges 20, 22, 44, 50, and 52. Similarly, panel 28 further includes first and second linear score lines 74*b* and 76*b* extending from and on opposite sides of the end of score line 72*b* at an obtuse angle in the order of 145° and spaced from edge 62. The first ends of score lines 74*b* and 76*b* are interconnected, with score lines 74*b* and 76*b* extending at an acute angle in the order of 70° from each other. The free ends of score lines 74*b* and 76*b* extend towards but are spaced from edges 30 and 26, respectively, with the free ends of score lines 74*b* and 76*b* located approximately 9% of the width between edges 26 and 30 from edges 30 and 26, respectively, in the preferred form. Also, the first ends of score lines 74*b* and 76*b* are located at a greater distance from edge 44 than their free ends, with the free ends of score lines 74*b* and 76*b* extending towards but spaced from edge 44 and specifically with the free ends of score lines 74*b* and 76*b* located approximately 30% of the height between edges 44 and 62 from edge 44 in the preferred form. Thus, score lines 72*b*, 74*b*, and 76*b* have a Y-shape of an identical shape and size as score lines 72*b*, 74*b*, and 76*b*, with score lines 72, 74, and 76 being spaced from edges 26, 30, 44, 59, and 64.

In the most preferred form, score lines 72, 74, and 76 are formed by scoring blank 16 and particularly by linearly indenting outer surface 17 creating a concave channel depression therein and creating a convex linear projection in inner surface 19 of panels 18 and 28.

It can then be appreciated that the bottom of carton 12 formed by the securement of outer flap 42 to inner flaps 38 and 42 closes and holds bottom edges 40 and 44 of panels 18, 24, 28, and 32, in the most preferred form, in a rectangular configuration. The top of carton 12 can be opened such as by removing the securement of panel 60 to panel 46, and panels 48, 54, 60, and 66 are pivoted about their respective fold lines from a closed position extending generally perpendicular to panels 18, 24, 28, and 32, respectively, to an open position extending other than perpendicularly to panels 18, 24, 28, and 32 and typically extending at an angle of 180° to 360° thereto. After the top of carton 12 is opened, panels 18, 28, 46, and 60 can be flexed into a non-planar shape with edges 48, 56, 62, and 68 of panels 18, 24, 28, and 32, respectively, and edges 47, 78, 96, and 80 of panels 46, 54, 60, and 66 being open and generally of an oval shape. Particularly, the oval shape has a length less than the width between side edges 20 and 22 of panel 18 and side edges 26 and 30 of panel 28 along edges 44 or of panels 18 and 28 in a static condition. Also, the oval shape has a width greater than the width between side edges 22 and 25 of panel 24 and side edges 20 and 30 of panels 32 along edges 40 or of panels 24 and 32 in a static condition. While held in this oval shape, the expanded opening of the top of carton 12 allows a larger container such as a measuring cup to reach into carton 12 and linear 14 for scooping out the dry ingredients therein. In particular, a container having a width much greater than the width between side edges 22 and 25 of panel 24 and side edges 20 and 30 of panel 32 can be inserted into the expanded opening of the top of carton 12. When removal of the dry ingredients from package 10 is no longer desired, carton 12 can be returned to its hollow rectangular parallelepiped shape. Typically, the outward forces of the dry ingredients placed on panels 24 and 32 and the tendency of panels 18 and 28 to return to a planar shape in static conditions which are enhanced by the bottom edges 40 and 44 being held in a rectangular configuration will return carton 12 to its hollow rectangular parallelepiped shape. In its static, hollow rectangular parallelepiped shape, the top of carton 12 can be closed by securing panel 60 to panel 46. In this regard, the Y-shape of score lines 72, 74, and 76 is believed to be advantageous. Specifically, spacing score lines 72, 74, and 76 from side edges 20 and 22 of panel 18 and side edges 26 and 30 of panel 28 and from bottom edges 44 gives rigidity to panels 18 and 28 to assist in their return to a static, planar condition. Additionally, the Y-shape divides panels 18 and 28 into 3 flat areas which have a geodesic configuration when panels 18 and 28 are flexed outwardly and have a tendency to return to a static planar condition. However, inward forces can be placed on panels 18 and 28 adjacent to edges 48 and 62, respectively, if desired or necessary depending upon the type of dry ingredients held in liner 14 and/or the rigidity of carton 12. It can then be appreciated that package 10 according to the teachings of the present invention includes panels 18 and 28 having larger faces while retaining narrow widths for panels 24 and 32 of the typical shape of packages. Package 10 allows scoop removal similar to that provided by canisters and specifically by containers which were previously too large to remove ingredients from typically shaped packages not utilizing the teachings of the present invention.

It can then be appreciated that although flexing is allowed in carton 12 by score lines 72, 74, and 76 of a generally Y-shape spaced from and intermediate side edges 20, 22, 26, and 30 and spaced from bottom edges 44 and is believed to be advantageous for strength reasons, flexing can be accomplished by other provisions. As an example, score lines in an inverted Y-shape, in a V-shape, in an inverted V-shape, or the like in panels 18 and 28 or by one or more score lines extending parallel to and intermediate side edges 20, 22, 26, and 30.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A package comprising, in combination: a carton comprising, in combination: a front panel having inside and outside surfaces, a top edge, a bottom edge, and first and second side edges; first and second side panels, with each of the side panels including inside and outside surfaces, a top edge, a botton edge, and first and second side edges; a back panel including inside and outside surfaces, a top edge, a bottom edge, and first and second side edges, with the first edges of the front and first side panels being connected about a fold line, with the second edges of the front and second side panels being connected about a fold line, with the second edges of the back and first side panels being connected about a fold line, with the first edges of the back and second side panels being connected about a fold line, with the height between the top edges and bottom edges of the front panel, the side panels, and the back panel being equal, with the width between the side edges of the front panel and the back panel being equal, with the width between the side edges of the first and second panels being equal, with the width between the side edges of the front panel and the back panel being substantially larger than the width between the side edges of the first and second side panels; a bottom closing and holding the bottom edges of the front panel, the side panels and the back panel in a rectangular configuration; and means for allowing the front and back panels to flex into a non-planar shape with the top edges of the front, side, and back panels being open and generally of an oval shape having a length less than the width between the side edges of the front panel and the back panel and a width greater than the width between the side edges of the first and second side panels, with the flex allowing means being spaced from the bottom edges and the first and second side edges of the front and back panels.

2. The package of claim 1 wherein the flex allowing means comprises at least a first score line located in each of the front and back panels extending from the top edges towards the bottom edges.

3. The package of claim 2 wherein the first score lines are parallel to the side edges of the front and back panels.

4. The package of claim 3 wherein the first score lines are intermediate the side edges of the front and back panels.

5. The package of claim 4 wherein the flex allowing means further comprises, in combination: second and third score lines located in each of the front and back panels and extending at an obtuse angle from and on opposite sides of the first score lines towards the side edges of the front and back panels.

6. The package of claim 5 wherein the second and third score lines are linear, with the second and third score lines extending from the first score line in a direction which is not linear with a corner of the edges of the front and back panels.

7. The package of claim 6 wherein the second and third score lines have first ends interconnected to each other and the first score lines and have second ends, with the first ends located at a greater distance from the bottom edges of the front and back panels than the second ends; and wherein the second and third score lines extend from the first score line in a direction which intersects the side edges above the bottom edges of the front and back panels.

8. The package of claim 1 wherein the flex allowing means comprises first and second score lines located in each of the front and back panels and having interconnected first ends, with the first and second score lines extending at an acute angle.

9. The package of claim 8 wherein the first and second score lines have second ends, with the first ends located at a greater distance from the bottom edges of the front and back panels than the second ends.

10. The package of claim 9 wherein the first ends of the first and second score lines are spaced from the top edges of the front and back panels.

11. The package of claim 6 wherein the first ends of the first and second score lines are spaced from the top edges of the front and back panels.

12. The package of claim 8 wherein the first and second score lines are linear, with the first and second score lines extending from the first ends in a direction which is not linear with a corner of the edges of the front and back panels.

13. The package of claim 12 wherein the first and second score lines have second ends, with the first ends located at a greater distance from the bottom edges of the front and back panels than the second ends; and wherein the first and second score lines extend from the first ends in a direction which intersects the side edges above the bottom edges of the front and back panels.

14. The package of claim 1 further comprising, in combination: a front top panel having a free top edge and a bottom edge, with the bottom edge of the front top panel being connected about a fold line to the top edge of the front panel; a back top panel having a free top edge and a bottom edge, with the bottom edge of the bottom top panel being connected about a fold line to the top edge of the back panel, with the back top panel including a tab and the front top panel including a slot for slideably receiving the tab for removably securing the back top panel to the front top panel; and wherein the flex allowing means includes means for allowing the front and back top panels to flex into a non-planar shape when the front and back top panels are in a position other than perpendicular to the front and back panels.

15. The package of claim 14 wherein the flex allowing means comprises at least a first score line located in the front panel and in the front top panel and located in the back panel and in the back top panel extending from the free top edges of the front and back top panels towards the bottom edges of the front and back panels.

16. The package of claim 15 wherein the first score lines are linear and are parallel to the side edges of the front and back panels.

17. The package of claim 16 wherein the flex allowing means further comprises, in combination: second and third score lines located in each of the front and back panels and extending at an obtuse angle from and on opposite sides of the first score lines towards the side edges of the front and back panels.

18. The package of claim 17 wherein the second and third score lines are linear, with the second and third score lines extending from the first score line in a direction which is not linear with a corner of the edges of the front and back panels.

19. The package of claim 18 wherein the second and third score lines have first ends interconnected to each other and the first score lines and have second ends, with the first ends located at a greater distance from the bottom edges of the front and back panels than the second ends; and wherein the second and third score lines extend from the first score line in a direction which intersects the side edges above the bottom edges of the front and back panels.

* * * * *